US006802725B2

(12) United States Patent
Rowland et al.

(10) Patent No.: US 6,802,725 B2
(45) Date of Patent: Oct. 12, 2004

(54) ELECTRICAL CONNECTOR ASSEMBLY

(75) Inventors: David J. Rowland, Fort Wayne, IN (US); Daniel D. Fritzinger, Milford, IN (US)

(73) Assignee: Theodore Bargman Company, Albion, IN (US)

( * ) Notice: Subject to any disclaimer, the term of this patent is extended or adjusted under 35 U.S.C. 154(b) by 0 days.

(21) Appl. No.: 10/779,972

(22) Filed: Feb. 17, 2004

(65) Prior Publication Data

US 2004/0161957 A1 Aug. 19, 2004

Related U.S. Application Data

(62) Division of application No. 10/306,152, filed on Nov. 27, 2002.

(51) Int. Cl.[7] ..... H01R 13/44
(52) U.S. Cl. ..... 439/144; 439/371
(58) Field of Search ..... 439/144, 142, 439/371

(56) References Cited

U.S. PATENT DOCUMENTS

| | | | | |
|---|---|---|---|---|
| 4,061,407 A | | 12/1977 | Snow | |
| 4,312,553 A | * | 1/1982 | Lyckesjo | 439/281 |
| 4,917,627 A | * | 4/1990 | Hendricks | 439/371 |
| 4,969,839 A | | 11/1990 | Nilsson | |
| 5,302,141 A | | 4/1994 | O'Reilly et al. | |
| 5,782,648 A | * | 7/1998 | Peterson | 439/369 |
| 5,873,744 A | * | 2/1999 | Ramos, Jr. | 439/144 |
| 5,980,278 A | | 11/1999 | Winkler | |
| 6,033,251 A | * | 3/2000 | Cook | 439/369 |
| 6,083,016 A | | 7/2000 | Waynick, Sr. | |
| 6,095,846 A | * | 8/2000 | Becerra | 439/371 |
| 6,254,406 B1 | | 7/2001 | Chiu et al. | |
| 6,336,822 B1 | | 1/2002 | Luzzoli | |
| 6,338,644 B1 | | 1/2002 | Fritzinger et al. | |
| 6,491,539 B1 | * | 12/2002 | Johnston | 439/373 |
| 6,554,626 B2 | * | 4/2003 | Ramos, Jr. | 439/144 |
| 6,565,383 B1 | | 5/2003 | Wu | |

* cited by examiner

*Primary Examiner*—Gary Paumen
(74) *Attorney, Agent, or Firm*—Price, Heneveld, Cooper, DeWitt & Litton, LLP

(57) ABSTRACT

An electrical connector assembly includes a first electrical connector and a second electrical connector. The first electrical connector includes a door for protecting contacts of the first electrical connector from environmental conditions when the first electrical connector is in an unmated condition. The second electrical connector includes an integral elongated strap and an integral clasp positioned approximate an outer shell of the second electrical connector. The strap is shaped to contact the door of the first electrical connector and interlock with the clasp to interlock the first and second electrical connectors when the first and second electrical connectors are mated.

14 Claims, 2 Drawing Sheets

ELECTRICAL CONNECTOR ASSEMBLY

This application is a division of U.S. patent application Ser. No. 10/306,152, entitled "ELECTRICAL CONNECTOR ASSEMBLY," by David J. Rowland et al., filed on Nov. 27, 2002, the disclosure of which is hereby incorporated by reference herein in its entirety.

BACKGROUND OF THE INVENTION

The present invention is generally directed to an electrical connector assembly and, more specifically, to an electrical connector assembly that is designed to better maintain electrical connection between electrical connectors of the assembly.

Various electrical connector assemblies have been proposed and/or manufactured that seek to maintain electrical connection between an electrical plug and an electrical receptacle. For example, U.S. Pat. No. 4,061,407 discloses an electrical connector assembly that has a cover that is hinged on an annular flange of an electrical receptacle. A latching member extends from an inner surface of the cover and is configured to engage an end of a key formed on an electrical plug. A plate member, which is mounted on a cable, engages an outer surface of the cover and biases the cover toward the plug, thus, holding the latching member against an end of the key and securing the plug in the receptacle. As is disclosed, the plate member may be made from a number of resilient materials that can be shaped to form a spring clip, such as a plastic or an elastomer, and may be attached to the plug with screws or other fastening devices.

U.S. Pat. No. 5,873,744 discloses a socket that includes a cover, which has a latching member formed on an inner surface of the cover. The socket receives a plug that includes a stop, which contacts the latching member, when the plug is connected to the socket, to maintain electrical connection between the plug and socket. U.S. Pat. No. 5,302,141 discloses a socket connector that has a housing with a cylindrical cavity. The socket connector has a cover that is spring biased toward a closed position. The cover includes a latch slot and a latch tab. The latch tab extends from a lower surface of the cover and the latch slot extends from an end of the cover and is shaped to latch over a latch post of a connector plug to secure the plug within the socket connector. The latch tab may engage an indexing key of a standard plug connector to secure the plug connector within the socket connector and, thus, maintain electrical connection between the connector plug and the socket connector.

U.S. Pat. No. 6,336,822 discloses a lever operated electrical power connector that includes a plug and receptacle. The plug includes a cylindrical body and the receptacle includes a cylindrical receptacle housing. The plug also includes a collar assembly that has an annular coupling ring that is freely rotated along the cylindrical body within predefined limits. The rotation of a handle, which extends from the annular coupling ring, serves to lock and unlock the plug and the receptacle.

While many electrical connector assemblies include mechanisms that function to maintain electrical connection between a male and female connector, it would be desirable to provide other simpler/additional locking mechanisms to ensure maintenance of the electrical connection between male and female connectors of an electrical connector assembly.

SUMMARY OF THE INVENTION

According to an embodiment of the present invention, an electrical connector assembly includes first and second electrical connectors. The first electrical connector includes a recess formed in an outer shell of the first electrical connector. The second electrical connector includes an integrated elongated spring clip extending from the second electrical connector. The recess is shaped to receive a portion of the elongated spring clip and the elongated spring clip interlocks the first and second electrical connectors, when positioned in the recess.

According to another embodiment of the present invention, an electrical connector assembly includes first and second electrical connectors. The first electrical connector includes a door for protecting contacts of the first electrical connector from environmental conditions, when the first electrical connector is in an unmated condition. The second electrical connector includes an integral elongated strap and an integral clasp positioned approximate an outer shell of the second electrical connector. The strap is shaped to contact the door of the first electrical connector and interlock with the clasp to interlock the first and second electrical connectors, when the first and second electrical connectors are mated.

These and other features, advantages and objects of the present invention will be further understood and appreciated by those skilled in the art by reference to the following specification, claims and appended drawings.

DETAILED DESCRIPTION OF PREFERRED EMBODIMENTS

According to one embodiment of the present invention, a mechanical locking mechanism for a trailer end connector is disclosed that includes a metal spring attached to the trailer end connector that mates with a recess in a car end connector. During operation, a user is required to actuate the spring in order to disconnect the trailer end connector from the car end connector. It should be appreciated that the positioning of the metal spring and the recess may be switched. That is, the metal spring may be attached to the car end connector and the recess may be formed in the trailer end connector.

According to another embodiment of the present invention, an integrally molded flexible elongated strap extends from a trailer end connector and is shaped to wrap around a car end door of a car end connector to secure the connectors. A free end of the strap is received by an integral clasp that extends from an outer shell of the trailer end connector. When locked to the clasp, the strap secures the trailer end connector to the car end connector.

Figure 1:
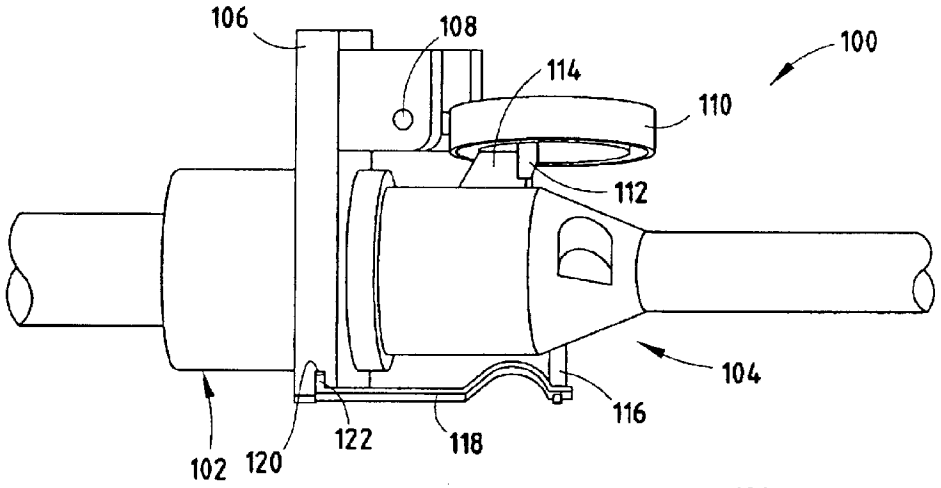
FIG. 1 is a side view of an electrical connector assembly, according to one embodiment of the present invention, in a mated condition.
Figure 2:
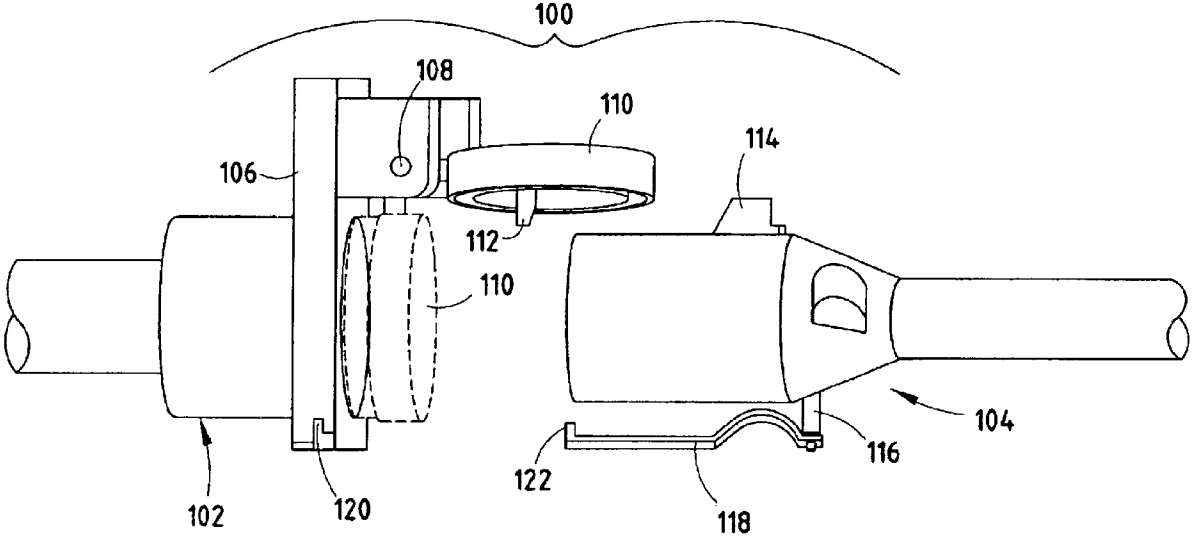
FIG. 2 is a side view of the electrical connector assembly of FIG. 1 in an unmated condition.

FIGS. 1 and 2 depict an electrical connector assembly 100, according to one embodiment of the present invention. As is shown, a second electrical connector 104 includes an attached elongated spring clip 118 that is integrated 116 (e.g., molded into an outer shell of the connector 104 or attached with a fastener) with the connector 104. The spring clip 118 extends from the connector 104 and is shaped to be received in a recess 120 formed in an outer shell of a first electrical connector 102.

The elongated spring clip 118 interlocks the first and second electrical connectors 102 and 104 when a portion 122 of the spring clip 118 is positioned in the recess 120. The spring clip 118 may be made of a variety of resilient material, such as spring steel, plastic, etc. When the first electrical connector 102 is a female connector, the second electrical connector 104 is a mateable male connector. When the first electrical connector 102 is a male connector, the second electrical connector 104 is a mateable female connector.

The first electrical connector 102 includes a mounting flange 106 that is shaped to receive a pin 108, which attaches a spring-biased door 110 to the flange 106. The flange 106 may include apertures (not shown) for receiving bolts to attach the connector 102 to a mounting bracket that is affixed to a rear bumper of a car. An inner surface of the door 110 includes a latching tab 112 extending from the inner surface of the door 110. As shown, the second electrical connector 104 includes an indexing key 114 that extends from its outer shell. The latching tab 112 engages the key 114 when the first and second electrical connectors 102 and 104 are in a mated condition.

According to one embodiment of the present invention, the first and second electrical connectors 102 and 104 are injection molded from a plastic material. Depending upon the configuration of the electrical connector assembly, it may be desirable to include multiple elongated spring clips to increase the security of the electrical connection between the electrical connectors of the assembly. Further, as mentioned above, it may also be advantageous for the spring clips to extend from the connector 102 and to form the recess in an outer shell of the connector 104.

Figure 3:
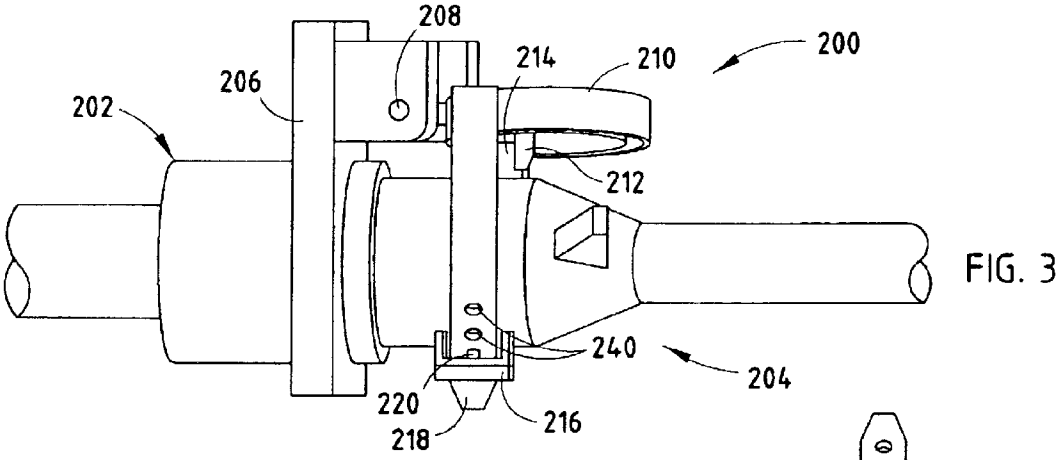
FIG. 3 is a side view of an electrical connector assembly, according to another embodiment of the present invention, in a mated condition.
Figure 4:
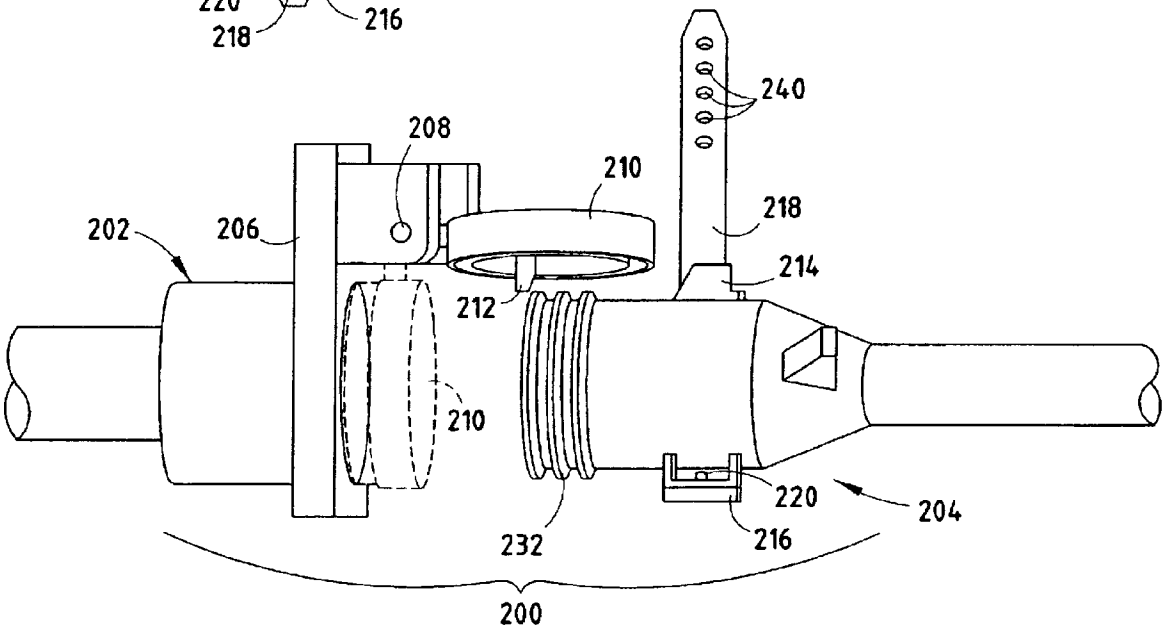
FIG. 4 is a side view of the electrical connector assembly of FIG. 3 in an unmated condition.

FIGS. 3 and 4 depict an electrical connector assembly 200, according to another embodiment of the present invention. A first electrical connector 202 includes a spring-biased door 210 for protecting contacts of the first electrical connector 202 from environmental conditions, when the connector 202 is in an unmated condition. The first electrical connector 202 includes an integral flange 206 that receives a pin 208 that couples the door 210 to the flange 206. An inner surface of the door 210 includes a latching tab 212 extending from the inner surface of the door 210. As shown, the second electrical connector 204 includes an indexing key 214 that extends from its outer shell. The latching tab 212 engages an end of the key 214, when the first and second electrical connectors 202 and 204 are in a mated condition. The second electrical connector 204 includes an integral elongated strap 218 and an integral clasp 216 positioned approximate the outer surface of the second electrical connector 204.

The strap 218 is configured to contact the door 210 of the first electrical connector 202 and includes apertures 240 that interlock with a post 220 of the clasp 216 to interlock the first and second electrical connectors 202 and 204, when the first and second electrical connectors 202 and 204 are mated. It should be appreciated that the clasp 216 and strap 218 may take a variety of forms, e.g., the strap and clasp may utilize hook and looptype fasteners such as those marketed under the trademark VELCRO®. As is shown, the second electrical connector 204 also includes integral flexible flaps 232 positioned along the outer shell of the second electrical connector 202. The flaps 232 seal the first and second electrical connectors 202 and 204, when the first and second electrical connectors 202 and 204 are mated, to protect electrical contacts of the connectors 202 and 204 from environmental conditions, e.g., moisture and dirt. It should also be appreciated that a connector implementing the above-described integral elongated strap and clasp can be advantageously utilized with any other connector that includes a door, including those that do not include a latching tab extending from an inner surface of the door.

Accordingly, electrical connector assemblies have been described herein, which include enhanced mechanical locking mechanisms for maintaining connection between a first and second electrical connectors of the assembly. In addition, an electrical connector assembly has been described herein that includes a connector with integral flexible flaps that seals the assembly from environmental conditions.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. An electrical connector assembly, comprising:

a first electrical connector including a door for protecting contacts of the first electrical connector from environmental conditions when the first electrical connector is in an unmated condition; and a second electrical connector including an integral elongated strap and an integral clasp positioned approximate an outer shell of the second electrical connector, wherein the strap is shaped to contact the door of the first electrical connector and interlock with the clasp to interlock the first and second electrical connectors when the first and second electrical connectors are mated.

2. The assembly of claim 1, further including:

integral flexible flaps positioned along the outer shell of the second electrical connector, wherein the integral flexible flaps seal the first and second electrical connectors when the first and second electrical connectors are mated.

3. The assembly of claim 1, wherein the clasp includes a post which is received in an aperture formed in the strap to interlock the first and second electrical connectors.

4. The assembly of claim 1, wherein the first electrical connector is a female connector and the second electrical connector is a male connector.

5. The assembly of claim 1, wherein the first electrical connector is a male connector and the second electrical connector is a female connector.

6. The assembly of claim 1, wherein the door includes a latching tab extending from a lower surface and the second electrical connector includes a key extending from the outer shell, and wherein the latching tab engages the key when the first and second electrical connectors are in a mated condition.

7. The assembly of claim 1, wherein the first and second electrical connectors are injection molded from a plastic material.

8. An electrical connector assembly, comprising:

a first electrical connector including a door for protecting contacts of the first electrical connector from environmental conditions when the first electrical connector is in an unmated condition;

a second electrical connector including an integral elongated strap and an integral clasp positioned approximate an outer shell of the second electrical connector, wherein the strap is shaped to contact the door of the first electrical connector and interlock with the clasp to interlock the first and second electrical connectors when the first and second electrical connectors are mated; and integral flexible flaps positioned along the outer shell of the second electrical connector, wherein the integral flexible flaps seal the first and second electrical connectors when the first and second electrical connectors are mated.

9. The assembly of claim 8, wherein the clasp includes a post which is received in an aperture formed in the strap to interlock the first and second electrical connectors.

10. The assembly of claim 8, wherein the first electrical connector is a female connector and the second electrical connector is a male connector.

11. The assembly of claim 8, wherein the first electrical connector is a male connector and the second electrical connector is a female connector.

12. The assembly of claim 8, wherein the door includes a latching tab extending from a lower surface and the second electrical connector includes a key extending from the outer shell, and wherein the latching tab engages the key when the first and second electrical connectors are in a mated condition.

13. The assembly of claim 8, wherein the first and second electrical connectors are injection molded from a plastic material.

14. The assembly of claim 8, wherein the integral flexible flaps of the first and second electrical connectors are injection molded from an elastomer material.

* * * * *